United States Patent [19]

Lau

[11] 4,192,619

[45] Mar. 11, 1980

[54] ELECTRONICALLY CONTROLLED PRINTER SYSTEM

[75] Inventor: Edward H. Lau, Old Westbury, N.Y.

[73] Assignee: Redactron Corporation, Yaphank, N.Y.

[21] Appl. No.: 650,414

[22] Filed: Jan. 19, 1976

Related U.S. Application Data

[63] Continuation of Ser. No. 492,692, Jul. 29, 1974, abandoned.

[51] Int. Cl.[2] ..... B41J 1/60

[52] U.S. Cl. ..... 400/163; 400/166

[58] Field of Search ..... 197/16, 17, 18, 49, 197/52, 55, 84 R, 12; 178/34, 38; 318/685; 400/163, 166

[56] References Cited

U.S. PATENT DOCUMENTS

| | | | |
|---|---|---|---|
| 3,239,049 | 3/1966 | Voit | 197/16 |
| 3,618,736 | 11/1971 | Abell et al. | 197/17 |
| 3,628,644 | 12/1971 | Cralle et al. | 197/12 |
| 3,665,410 | 10/1972 | Kapp | 197/55 |
| 3,788,443 | 1/1974 | Menzi | 197/16 |
| 3,789,971 | 2/1974 | Deyesso et al. | 197/18 |
| 3,794,150 | 2/1974 | Cahill et al. | 197/55 |
| 3,838,764 | 10/1974 | Decker | 197/52 |
| 3,888,339 | 6/1975 | Nowak et al. | 197/55 |
| 3,980,169 | 9/1976 | Decker et al. | 197/55 |

*Primary Examiner*—Paul T. Sewell

*Attorney, Agent, or Firm*—Hane, Roberts, Spiecens & Cohen

[57] ABSTRACT

A printer has a print shell on which are disposed type characters in a two dimensional array with the shell controllably movable in two degrees of freedom to selectively position each type character opposite a record-medium-carrying platen for printing. In addition, during printing the shell is driven against the platen with a force related to the particular character being printed, and associated with the printing is an indexing or transverse spacing of the print shell to expose new portions of the record medium for printing. As each character is to be printed, a coded combination of signals associated with such character is translated and converted to four further signals wherein two of which control the movement of the print shell in the two axes of freedom to select the desired type character for printing while a third signal controls the velocity at which the print shell is driven against the platen to insure uniform shading of the print regardless of the impact surface of the character and the fourth signal controls the amount of transverse spacing to provide proportional as well as monospacing of the printed characters.

6 Claims, 14 Drawing Figures

PRINTER SYSTEM PS

PRINTER SYSTEM PS

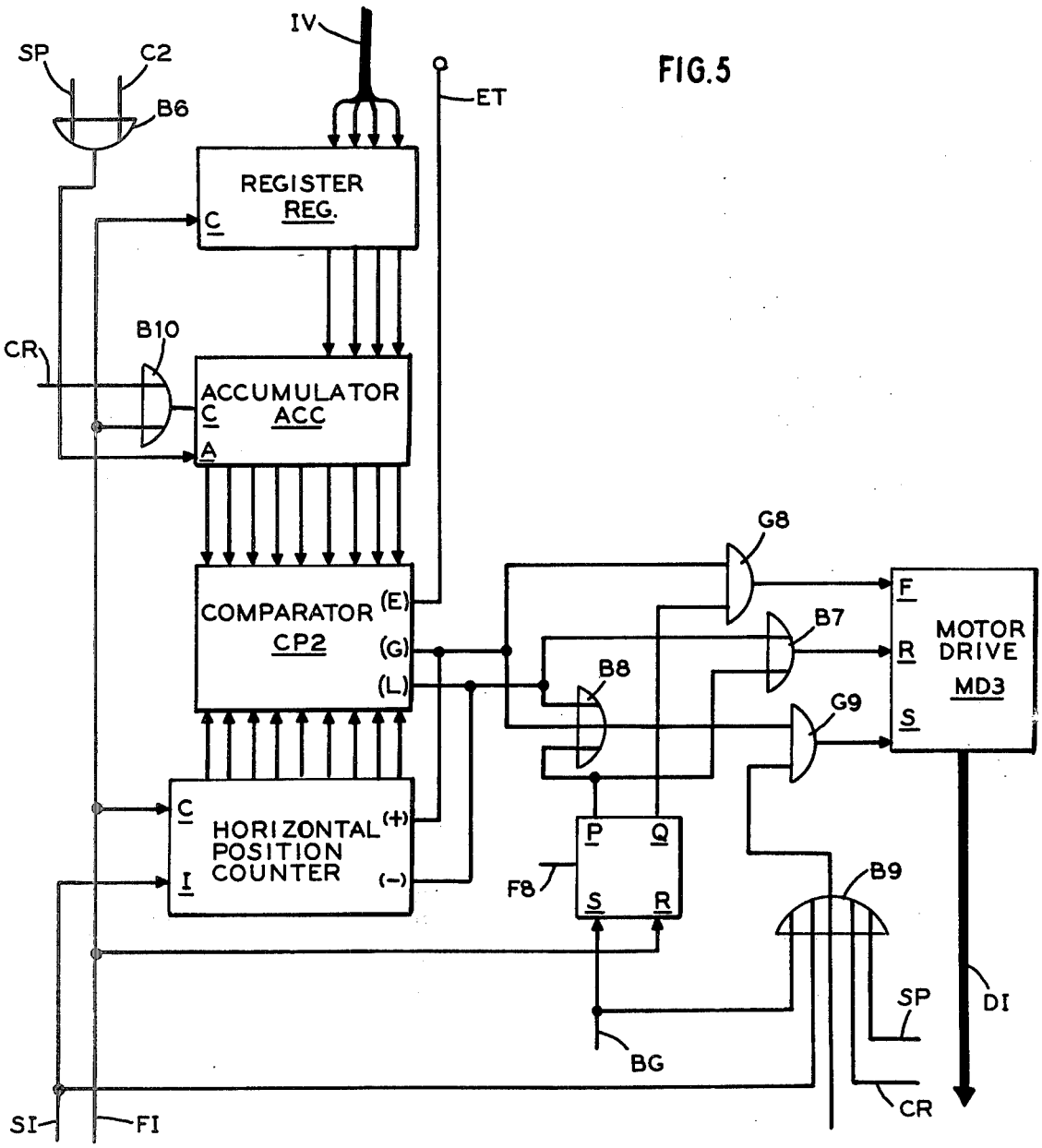
INDEX CONTROL IC

ELECTRONICALLY CONTROLLED PRINTER SYSTEM

This is a continuation, of application Ser. No. 492,692, filed July 29, 1974, now abandoned.

This invention pertains to printers and more particularly to single element printers which are electronically controlled.

Of the many uses for printers there are two which predominate in number. They are keyboard controlled typewriters and signal controlled output devices for computers, communications terminals and the like. In fact, many such output devices utilize conventional electric typewriters. Of the conventional electric typewriters the single element print head variety as exemplified by the IBM Selectric family have become the most popular. While such typewriters are adequate for many tasks, it should be realized they are highly complex machines containing innumerable mechanical drives, linkages and the like. This complexity results in an initially expensive machine. In addition, while a typewriter is satisfactory for use by a typist, it not only has a too low upper limit of speed when driven by a computer or the like, but also is not sufficiently rugged for the extended periods of continued use required in many computer, word processing and communications applications. Furthermore, such machines are noisy. These limitations arise from the mechanical complexity of presently available typewriters.

It is, accordingly, a general object of the invention to provide an improved printer.

It is another object of the invention to provide an improved printer wherein coded combinations of signals represent the characters to be printed and these coded combinations of signals are processed to select the type characters for printing.

It is a further object of the invention to provide an improved single element print head printer.

In such a machine all the type characters of a font are located on the surface of one print device which may be positioned for printing engagement with a platen. Of such devices the most common and versatile is a printing head having a truncated spherical shell with characters arranged in rows and columns about the peripheral surface of the shell. A character is selected for printing by rotating and tilting the shell. In particular, there is actuated by a displacement mechanism having two principal portions, one for tilting and another for rotating the shell. More specifically, selecting links are operated which determine the pivot points of connecting members to produce an output of predetermined displacement and direction. In each portion of the displacement mechanism, the value of output is determined by the links selected either singly or in combination. When the links are selected in combination the displacement is the sum of the individual displacements of the links. A tape and pulley mechanism couple the displacement mechanism to the printing head to locate the selected character is a reference position. Thereafter, the head is caused to strike the platen to print the chosen character. A more complete discussion of such machines can be found in U.S. Pat. No. 2,919,002.

It is another object of the invention to replace such complex mechanisms for tilting and rotating the shell by eletrically operated servosystems wherein signals are sent to motors which then rotate and tilt the shell to the desired position and indicate such position to initiate the printing of the selected character.

In such previously available printers there is an impression or impact control to insure that each character when printed has the same shading. In other words, when printing a period or a comma less impact is required than when printing an m or a w. The usual impression control utilizes a constant speed cycle motor and a plurality of selectable cams which drive the print element against the platen. While this configuration adequately performs the impact control function, it is apparent that the utilization of selectable cams again complicates the mechanism and slows down the printing speed.

It is, accordingly, another object of the invention to simplify the impression or impact control portion of the printer by connecting the drive motor via a single cam on the shaft of the drive motor to the print head or rocker and control the speed of rotation of such motor to control the impact force.

With such single element print head devices the high print quality is obtained because the print shell is mechanically detented before impact. The nature of detenting limits the possible speed of operation as well as submitting several elements to wear.

It is, accordingly, another object of the invention to modify the presently known detenting arrangement to permit high speed operation and longer life for the print head.

Other objects, the features and advantages of the invention will be apparent from the following detailed description when read with the accompanying drawing which shows by way of example, and not limitation, and exemplary embodiment of the invention.

In the drawing:

FIG. 5 is a logic diagram of the index control of FIG. 1;

Figure 1:
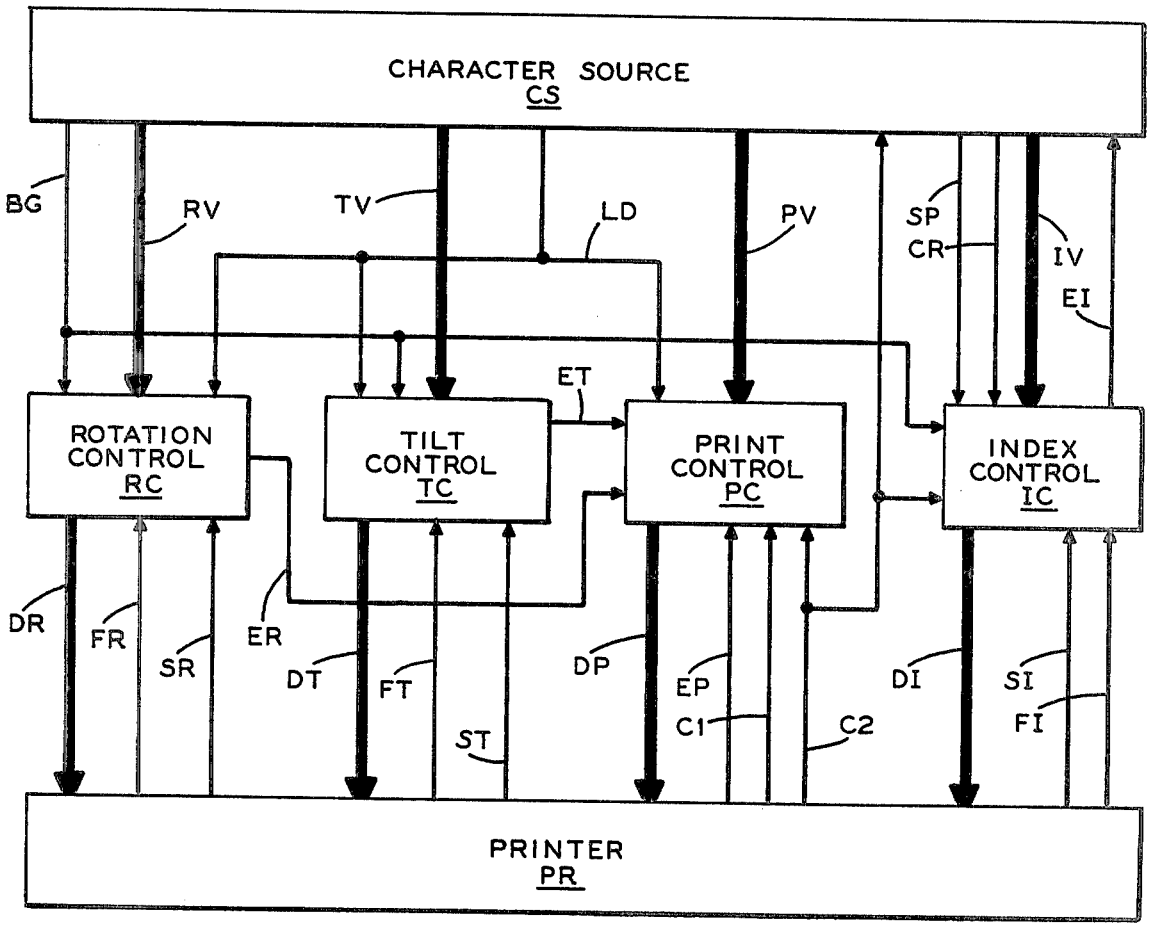
FIG. 1 shows a block diagram of a printer system in accordance with the invention.

The printer system in accordance with the invention as shown in FIG. 1 includes a printer PR which is connected to character source CS via rotation control RC, tilt control TC, pinter control PC and index control IC. The printer PR hereinafter more fully described, includes a single element print head having a print shell upon the partially spherical surface on which are disposed, by way of example, four rows of twenty-two type characters. At any given time one of these type characters occupies a print position, i.e., directly opposite a platen so that when the print shell is driven against a record medium carrying platen, the desired character is printed on the record medium. Each type character on the print shell can be represented by a two-quantity address relative to this print position or another fixed position. In particular, each type character is given an address having a first part indicating the row containing the character and a second part indicating its position within the row. The print shell is connected via a shaft to a bidirectional motor (such as but not necessarily a step motor) which rotates the print shell to present different type characters within a row for printing when receiving signals via cable DR from rotation control RC. In addition, coupled to the shaft is a transducer which emits pulses on line SR for each character increment of rotation of the shaft. A second transducer on the shaft emits a single pulse (fiducial) of line FR when the shaft has a specific angular position, i.e. the fiducial point or home position. The print shell is also connected via a linkage to another motor of the same type as mentioned above which rotates when receiving signals on line DT from tilt control TC to tilt the shell for making available different rows of type characters for printing. Similarly, this motor is connected to transducers which emit pulses on lines FT and ST representing respectively the fiducial point (or home position) and each row increment of tilt.

The print shell is carried on a print head or rocker which is driven toward the platen to print the available character of the print shell. This is accomplished by mechanisms driven during the single revolution of a motor (for example, but not necessarily a step motor) in response to signals on line DP from print control PC. When a step motor is used the rate at which pulses occur on line DP determines how fast the motor rotates. Connected to the shaft of this step motor is a transducer which generates a single pulse on each of the lines EP, C1 and C2. During the single rotation, a pulse on line C2 occurs when actual driving of the print head begins, a pulse on line C2 occurs when actual driving has ended, and a pulse on line EP occurs at the end of the revolution.

The print head is supported on a print carrier which is driven laterally parallel to the platen to position the print head sequentially opposite different portions of the record medium (i.e. horizontal indexing or escaping and hereinafter called indexing) so that a line of characters can be printed. The indexing is performed by mechanisms driven by a bidirectional motor (for example but not necessarily, a step motor) in response to signals on cable DI from index control IC. Fixed to the shaft of this motor is a transducer which emits a pulse on line SI for each index increment the shaft has rotated. There is a transducer adjacent to the path of travel of the carrier to indicate when the carrier is at a left margin position by emitting a single fiducial pulse on line FI.

The character source CS hereinafter described in detail includes a character code generator which generates coded combinations of bits representing characters such as ASCII or teletype codes and also generates a "sprocket" pulse indicating a character code is available. There are two types of characters generated. The first type are the alphanumerics and symbols which must be printed and the second type control movement of the carrier, i.e., space, backspace, tab and carrier return. The source CS includes means for detecting the second type of characters and transmitting unique signals representing these characters. For example, when the character is a carrier return or a space, signals are fed respectively on lines CR and SP to index control IC. For each of the printable characters source CS includes a translator which converts, at least for the printable characters, the character code into: a first binary code (number) which is fed bits-in-parallel, on cable RV to rotation control RE, this number representing the rotational or column address of the character on the print shell; a second binary code (number) which is fed, bits-in-parallel, on cable TV to tilt control TC, this number representing the row address of the character on the print shell; a third binary code (number) which is fed, bits-in-parallel, via code PV to print control PC, this number representing the required impact force for the character; and a fourth binary code (number) which is fed, bits-in-parallel, via cable IV to index control IC, this number represents how many index increments should be performed for the character to permit proportional spacing.

The rotational control RC in general comprises: an absolute position counter which registers as binary number the instantaneous rotational position of the print shell and is unit incremented or decremented in response to pulses on line SR in accordance with the direction of rotation of the shell and is cleared to a home value upon receipt of the fiducial pulse on line FR; a desired position register which receives from lines RV and stores the rotational position or address of the desired character and a comparator means which compares the numbers stored in the counter and register to transmit a signal on line ER when the numbers are equal, and to transmit directional drive signals on cable DR to printer PR.

Tilt control TC is generally the same as rotational control RC and receives its desired address from cable TV, its fiducial pulse from line FT and tis incrementing or decrementing pulses from line ST while transmitting its directional drive signals on calbe DT and its equality indicating signal on line ET.

Print control PC is basically a controlled pulse generator which transmits a sufficient number of step signals on cable DP to cause the print control step motor printer PR to perform one revolution starting effectively with the coincidence of signals on lines LD, ET and ER. During the first portion of the cycle up to the receipt of a signal on line C1 the pulses are generated at a first fixed rate. During the second portion of the cycle up to the receipt of a signal C2, i.e., the time when effective impact 's taking place the pulses are generated at a rate determined by the binary number received from cable PV. During the last portion of the cycle the pulses are generated at a still higher rate, and then ramped down to a stop to finish the cycle as indicated by a signal on line EP.

The index control IC generally comprises: an absolute position counter which registers as a binary number the instantaneous lateral position of the carrier which is unit changed in response to pulses on line SI in accordance with the direction of movement of the carrier; a next position register which is an accumulator register for storing a binary number which gets changed by an amount indicated by the number of line IV; and a comparator means which compares the numbers stored in the counter and register to transmit directional drive signals on cable DI to printer PR. For printed characters the indexing starts under the control of a pulse from line C2. For non-printed characters such as space and carrier return, the indexing starts under the control of the receipt of signals on lines SP and CR respectively.

The operation of the printer system PS as shown in FIG. 1 will now be described. The character source CS first emits a pulse on line BG to initialize the rotation, tilt and index controls and phase their counters with the associated step motors in the printer PR. The first character to be printed appears in character source CS which in turn emits four coded combinations of bits, representing binary numbers, on cables RV, TV, PV and IV, respectively.

The binary numbers received by rotation control RC and tilt control TC immediately initiate rotation and tilting of the print shell to move the selected type character to the print position by feeding signals on lines DR and DT to the respective drive motors. During the movement, unit changing pulses are fed via lines SR and ST to the associated absolute position counters. When the count in the absolute position counter and the number in the desired position are equal indicating the desired rotational position of the shell is being reached rotation control RC emits a signal on line ER. Similarly tilt control TC emits a signal on line ET. These signals do not necessarily occur simultaneously. However, when they both are present print control PC is activated.

Print control PC starts emitting stepping signals at a first rate driving its stepping motor for a single revolution. Somewhere during the revolution the actual driving of the print rocker toward the platen begins. This time is indicated by a pulse on line C1 which now causes print control PC to change the rate at which it feeds stepping signals to a rate related to the value of the binary number received on line PV. Thus the velocity of the drive motor and consequently the force of impact of the print head against the platen are controlled by the value of the binary number. When the actual drive portion of the cycle is over as indicated by a pulse on line C2, the rate of stepping signals is speeded up to complete the cycle as indicated by a pulse on line EP.

The instant the head contact (print) portion of the cycle is over, the carrier can be indexed and a new character can be called for. Therefore, the pulse on line C2 is fed to character sources CS to call for the next character and to index control IC to perform the indexing. Index control IC emits stepping signals on line DI to drive the associated step motor. As the motor rotates to perform the indexing, index increment pulses are fed back on line SP to increment the absolute position counter. When the absolute position counter and the next position register are equal, the print head is at its next position and index control IC emits a pulse on line EI to character source CS which ignores this pulse since it already has been signalled to produce the next character by the pulse on line C2.

Now, for a non-print character such as space or carrier return, character store CS transmits an index number on cable IV to index control IC along with the associated signal on line SP or CR. Note that no load signal is present on line LD at this time. Therefore, regardless of the numbers on cables RV, TV and PV, neither the shell nor the print head move and only indexing of the carrier is performed. When the indexing is finished as indicated by a signal on line EI the next character is called for in character source CS by this signal due to the absence of signal on line C2.

Figure 2:
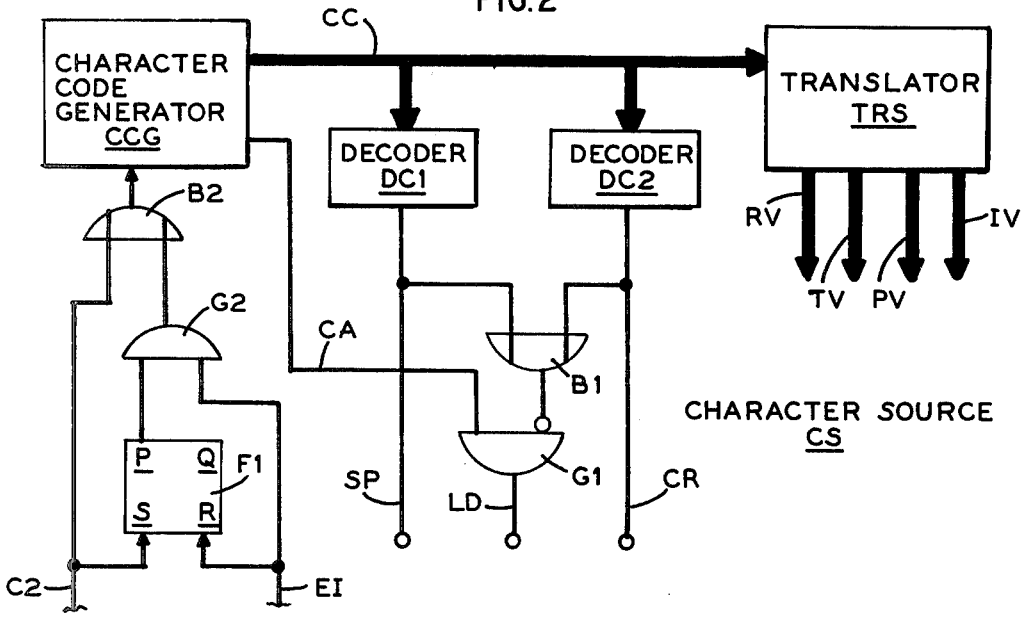
FIG. 2 is a logic diagram of the character source of FIG. 1.

The character source CS shown in FIG. 2 centers around character code generator CCG which is connected by multiline cable CC to translator TRS. Character code generator CCG can take on many forms such as a keyboard, a computer, miniprocessor, a modem, a teletypewriter, a magnet tape, disc, card or drum memory, etc. Its requirement is that it serially present coded representations of characters to be printed. Preferably, the character codes are presented bits in parallel onto cable CC. For example, if ASCII Code is being used then the eight bits of the code are presented simultaneously on eight parallel lines of cable CC. After each character code is so presented code generator CCG emits a character available pulse on line CA.

Translator TRS can take on many forms such as a decoding matrix, an addressable random access memory, a read only memory, etc. For example, consider an addressable random access memory where there is a register for each possible character and wherein each register has an address which is represented by the ASCII code representing the character. Furthermore, each register is divided into four fields: one representing the rotation position of the character, a second the tilt position, the third the impact value and the fourth the index value. It is also possible to use a decoding matrix which translates the character code into rotation and tilt values, while an addressable memory stores the impact and index values. In any event, whenever a character code is present on the lines of cable CC, translator TRS emits the binary number bit-in-parallel for rotation on the lines of cable RV, the bits-in-parallel binary number for the tilt on the lines on cable TV, the bits-in-parallel binary number for impact on the lines of cable PV, and the bits-in-parallel binary number for indexing on the lines of cable IV.

To indicate the occurrence of a space character and a carrier return character, the decoder DC1 and decoder DC2 are connective respectively in parallel to cable CC. Each decoder for ASCII code can be an eight-input AND-circuit whose inputs are direct or inverting in accordance with the bit values of the character codes. The outputs of the decoders are connective respectively to lines SP and CR which are also connected to the inputs of two-input OR-circuit B1. The output of OR-circuit B1 is connected to the inhibiting input of two-input AND-circuit G1 whose second input is connected to line CA and whose input is connected to line LD. Thus, whenever a printable character is presented by code generator CCG to translator TRS, its four associated binary words are fed onto cables RV, TV, PV and IV while the character-available-pulse of line CA is fed to line LD so that the four associated binary words are loaded into the respective registers of the four controls RC, TC, PC and IC. When a non-printable character such as space or carrier return is presented, either a pulse on line SP or on line CR is fed to index control IC while the character available pulse of line CA is blocked from entering line LS so that the contents of the registers in controls RC, TC and PV remain unchanged.

If code generator CCG is a manual operated keyboard then the presentation of characters therefrom will be much slower than the remainder of the system can accept and print the characters. However, if the code generator is a computer or other device which can present characters faster than the remainder of the system can accept characters, then it is necessary to indicate to the code generator when the printer PR can accept a new character. In such case, near the end of everyprint cycle of a printable character the pulse signal on line C2 passes through OR-circut B2 to indicate to the code generator that the next character can be present. At the same time the pulse which fed to the set-input of flip-flop F1 sets the flip-flop which blocks AND-circuit G2, whose output is connected to the second input of OR-circuit B2.

The reset input of flip-flop F1 which is connected to line EI will only respond to the trailing edge of a signal to trigger the flip-flop to the reset state. Thus, any pulse of line EI at the end of indexing resulting from the printing of a character has no effect. However, for a non-printable character there is no pulse on line C2 and the flip-flop is not set so that the pulse occuring on line EI passes via AND-circuit G2 and OR-circuit B2 to the code generator CCG indicating that the next character should be transmitted.

Figure 3:
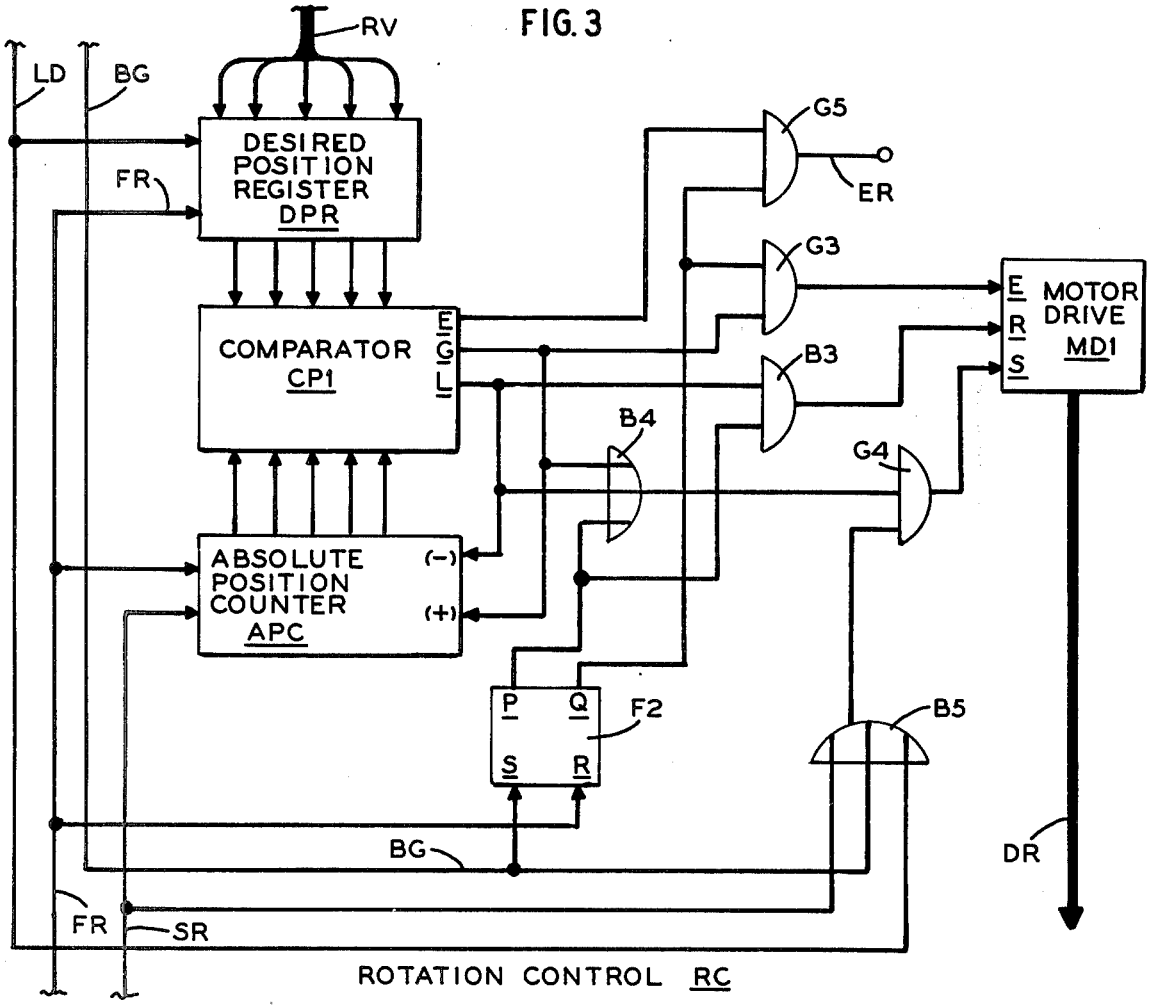
FIG. 3 is a logic diagram of the rotation control of FIG. 1

The rotation control RC shown in FIG. 3 centers around conventional bits-in-parallel comparator CP1 which compares the binary number in desired position register DPR (a conventional parallel flip-flop register loaded from cable RV under control of a signal on line LD) with the binary contents of absolute position counter APC (a conventional unit up-down counter which is stepped by pulses on line SR) to give a signal at one of its outputs. E,G,L depending on whether the number in counter APC is equal to, greater than or less than, respectively, the number in register DPR. The outputs G and L are respectively connected via AND-circuit G3 and OR-circuit B3 to the forward and reverse inputs F and R respectively of motor drive MD1 to control which direction of stepping signals will be fed on output cable DR in response to a step pulse received at step terminal S.

The rotation control RC operates in the following manner: At the start of operation, the pulse signal and line BG sets flip-flop F2 causing its P output to go high and its Q output low. Consequently, assuming position logic, AND-circuit G4 is opened via OR-circuit B4, the R input of motor drive MD1 is energized via OR-circuit B3, and AND-circuits G3 and G5 are blocked. This in effect negates any control by comparator CP1. The pulse on line BG also passes via OR-circuit B5 and AND-circuit G4 to the step input S of motor drive MD1. Drive MD1 emits stepping signals on cable DR causing the associated stepping motor in the printer to move in the reverse direction. Its associated transducer emits a pulse on line SR which is fed via OR-circuit B5 and AND-circuit G4 to the step input of motor drive MD1 which causes another step of the motor. This continues until the shell is rotated to the fiducial position when the associated transducer emits a pulse on line FR which clears register DPR and counter APC to zero and resets flip-flop F2. Consequently, AND-circuits G3 and G5 are opened while AND-circuit G4 is closed breaking the feedback loop and ending the stepping of the motor until a printable character is presented.

At that time the rotational position of the desired printable character is received at register DPR from character source CS via cable RV, and entered therein in response to a pulse on line LD. Comparator CP1 will indicate an inequality and particularly that the contents of register DPR is greater than the contents of counter APC resulting in a signal at the output G. The signal is fed to the (+) input of counter APC to condition it to act as an up counter and the signal also passes through AND-circuit G3 to the forward input F of motor drive MD1. At the same time the pulse on line LD passes through OR-circuit B5 and AND-circuit G4 (now open because of the signal on output G of comparator CP1 passes through OR-circuit B4 to an input thereof) to the step input of motor drive MD1. The step signals from motor drive MD2 on the cable DR step the step motor causing its associated transducer to generate a rotational increment pulse on line SR. The pulse on line SR unit increments the quantity in counter APC and if the inequality still exists, the signal on output G still keep AND-circuit G4 open. Therefore, the pulse on line SR passes through OR-circuit B5 and AND-circuit G4 to the motor drive and another step is performed. This automatic stepping continues until the quantities of the register DPR and APC are equal. At that time, the signal on ouput G disappears and a signal appears on output E of comparator CP1. Thus, AND-circuit G4 is blocked stopping the free-running stepping and a signal passes through AND-circuit G5 onto line ER indicating the desired rotational position has been reached.

If the next character to be printed requires a further rotation in the forward direction the positioning operation is the same as describe above. However, if a rotation in the reverse direction is required as indicated by a signal on output L of comparator CP1, everything is the same as above, except that the signal on line L passes through OR-circuit B3 to indicate reverse stepping of the motor and energizes the (−) input of counter APC to cause unti decrementing by counter APC in response to pulses on line SR.

The tilt control TC is the same as rotation control RC except that since there are only four tilt positions instead of twenty-two rotation positions register DPR which is a five place register can be replaced by a two place register and counter APC which is a five stage counter is replaced by a two stage counter. In addition, cables RV and DR are replaced by cables TV and DT respectively, while lines FR and SR are replaced by lines FT and ST, respectively.

Figure 4:
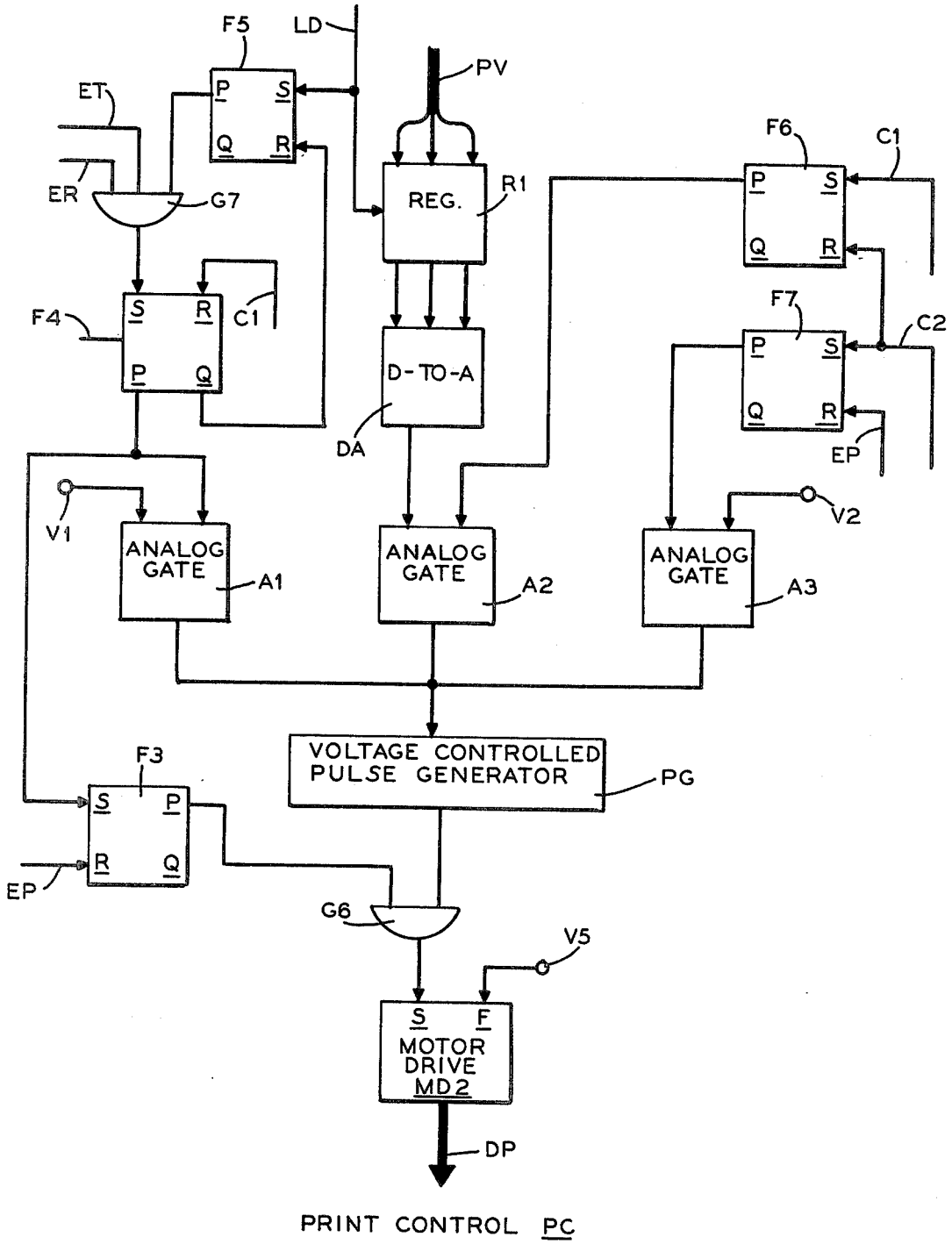
FIG. 4 is a logic diagram of the print control of FIG. 1.

Print control PC as shown in FIG. 4 centers around voltage controlled pulse generator PG whose output is connected via AND-circuit G6 to the step input of motor drive MD2 which is biased by means of voltage source VS to step only in the forward direction. Voltage controlled pulse generator PG can be a free-running pulse generator of the multivibrator type whose pulse repetition rate is controlled by the amplitude of a D.C voltage received at is input. (Basically this voltage is used as the charging or discharging voltage of one of the time constant circuits of multivibrator). The remaining circuits determine the input voltage to the pulse generator. The input voltage controls the pulse repetition rate of the pulse generator which in turn determines the stepping rate of the stepping motor and consequently the angular velocity of its shaft.

In operation, whenever a character is to be printed the binary number representing the impact value of the character is presented to flip-flop register R1 and is loaded therein under control of a pulse on line LD. The binary number in the register is converted to a D.C. voltage by digital-to-analog converter DA and fed to an input of analog gate A2. At the same time the pulse on line LD sets flip-flop F5 which alerts AND-circuit G7. When the print shell is in or approaching the desired character position for printing as indicated by signals on lines ET and ER. AND-circuit G7 passes a signal which sets flip-flop F4. The setting of flip-flop F4 results in the clearing or resetting of flip-flop F5 since the Q output of the latter is connected to the R input of the former. In addition, since the P output of flip-flop F4 is connected to the control input of the analog gate A1 the voltage V1 connected to the signal input of the gate A1 passes to the input of the pulse generator PG. Note, an analog gate is merely an electronic switch which controls the linear transmission of a signal from its signal input to its output. If the voltage V1 is a constant amplitude D.C. voltage, then pulse generator PG will start emitting pulses to motor drive MD2 at a given rate causing the print step motor to move at a first velocity. It is possible to use a changing voltage so that the motor is smoothly accelerated up to a given speed. Note, when flip-flop F4 was set, it in turn set flip-flop F3 which alerted AND-circuit G6 permitting the pulses from pulse generator PG to enter the step input S of motor drive MD2. In any event, when the step motor has rotated a given amount and just before actually printing is to occur the associated transducer emits a pulse on line C1 which clears flip-flop F4, blocking analog gate A1, and which sets flip-flop F6 opening analog gate A2. Now, the D.C. voltage being transmitted by digital-to-analog converter DA is fed to the input of pulse generator PG. The amplitude of this voltage represents the desired impact force for the character. Thus the pulses now transmitted from pulse generator PG to motor drive MD2 change the velocity of the step motor to conform to the desired impact force. This velocity is different from the first velocity and will be one of a set of different velocities each related to the desired impact force. The desired impact force is related to the type of character to be printed. When the actual driving of the print head is over, the associated transducer on the stepping motor shaft emits a pulse on line C2 which clears flip-flop F6 closing analog gate A2, and which sets flip-flop F7 opening analog A3 causing the voltage V2 to control the stepping rate. This voltage is chosen to speed up stepping so that the cycle is finished as soon as possible as indicated by a pulse on line EP from the transducer. The pulse on line EP clears flip-flop F7 blocking analog gate A3, and clears flip-flop F3 blocking AND-circuit G6 terminating the transmission of stepping signals to the motor.

The index control IC as shown in FIG. 5 centers around comparator CP2 which is similar to above described comparator CP1. Generally comparator CP2 compares the binary number in accumulator ACC with binary number in horizontal position counter HPC and emits signals at terminals E, G and L to indicate whether the number in the accumulator is respectively equal to, greater than or less than the number in to counter so as to control motor drive MD3. Horizontal position counter HPC is a conventional up-down counter which unit increments the pulses on line SI connected to input I when its (+) input is energized and which unit decrements the pulses on line SI connected to imput 1 when its (−) input is energized. Accumulator ACC can be a parallel binary arithmetic unit and an internal storage register wherein it will add the contents to register REG to the contents of the internal storage register upon receipt of a control signal at input A. The accumulator is cleared when it receives a pulse at clear input C.

In operation the initializing pulse on line BG sets flip-flop F8 whose P output alerts AND-circuit G9, via OR-circuit B8, and energizes the R or reverse input of motor drive MD3 via OR-circuit B7 while the Q output blocks AND-circuit G8. Thus, comparator CP2 is effectively neutralized and motor drive MD3 can only transmit reverse or backward stepping signals to the associated carrier indexing motor in the printer. At the same time to signal on line BG passes via OR-circuit B9 and AND-circuit G9 to step motor drive MD3 and the first reverse horizontal increment is initiated resulting in the associated transducer sending back a pulse on line SI which passes through OR-circuit B9 to again step the motor drive MD3. This continues until the carrier is driven to the "left hand margin" when a transducer in the path of the carrier as hereinafter described emits a pulse on line FI which clears register REG, accumulator ACC, counter HPC and flip-flop F8. Comparator CP2 emits a signal on line EI calling for delivery of the first character and AND-circuit G9 is blocked ending the free stepping of the motor drive, i.e. the feedback path is broken. When the first printable character is presented, its width increment or the number of index increments to be performed is loaded into register REG from cable IV. After the character is printed, a pulse is received on line C2 which triggers accumulator ACC to add this number to the number it is storing. Thus, since the contents of the accumulator is greater than that of counter HPC, comparator CP2 emits a signal on line G. The signal passes via AND-circuit G8 to the forward input F of motor drive MD3 and via OR-circuit B8 to alert AND-circuit G9, and passes to the (+) input of counter HPC. At the same time the pulse on line C2 passes via AND-circuit G9 to the step input of motor drive MD3 resulting in the generation of the first of the stepping signals on cable DI.

The motor starts moving the carrier to the right and the associated transducer emits a horizontal pulse on line S1 causing a unit incrementing of counter HPC. The pulse also passes via OR-circuit B9 and AND-circuit G9 to the step input S of motor drive MD3 causing the transmission of the next of the stepping signals to the motor. These cycles repeat until the number in counter HPC equals the number in accumulator ACC. At that time comparator CP2 transmits a signal from output E onto line EI calling for the next character and terminates the signal on line G blocking AND-circuit G9 and breaking the feedback path to stop the stepping.

If a character is a space character there is no print cycle and therefore no pulse on line C2. Accordingly, a pulse on line SP passes through OR-circuit B6 to control accumulator ACC. In addition the pulse on line SP passes through OR-circuit B9 to provide the first stepping pulse. If a tab or a backspace were called for, signal lines similar to signal line SP from character source CS, although not shown, would be used.

When a carrier return is called for, a signal is present on line CR which passes via OR-circuit B10 to clear accumulator ACC. Clearly the contents of the accumulator ACC are less than the contents of counter HPC. This causes the generation of a signal on output L of comparator CP2. This signal is fed to the (−) input of counter HPC which now acts as a down counter, passes via OR-circuit B7 to the reverse input R of motor drive MD3, and passes via OR-circuit B8 to alert AND-circuit G9. The CR signal also passes via OR-circuit B9 and AND-circuit G9 to the step input S of motor drive MD3 causing the transmission of the first reverse stepping signal on cable DI to the carrier indexing motor which starts driving to carrier toward to left hand margin. The associated transducer emits the first horizontal incrementing pulse on line SI. This pulse unit decrements the count in counter HPC and becomes the next stepping pulse via OR-circuit B9 to motor drive MD3. These cycles continue until the count in counter HPC equals the count in accumulator ACC or until the left margin transducer emits or pulse on line FI clearing counter HPC, accumulator ACC and register REG. At that time comparator CP2 generates a signal on terminal E which is fed via line EI to the character source CS to call for a new character. At the same time the signal on output L terminates, blocking AND-circuit G9 and free running steps terminate with the type carrier at the left hand margin.

Figure 7:
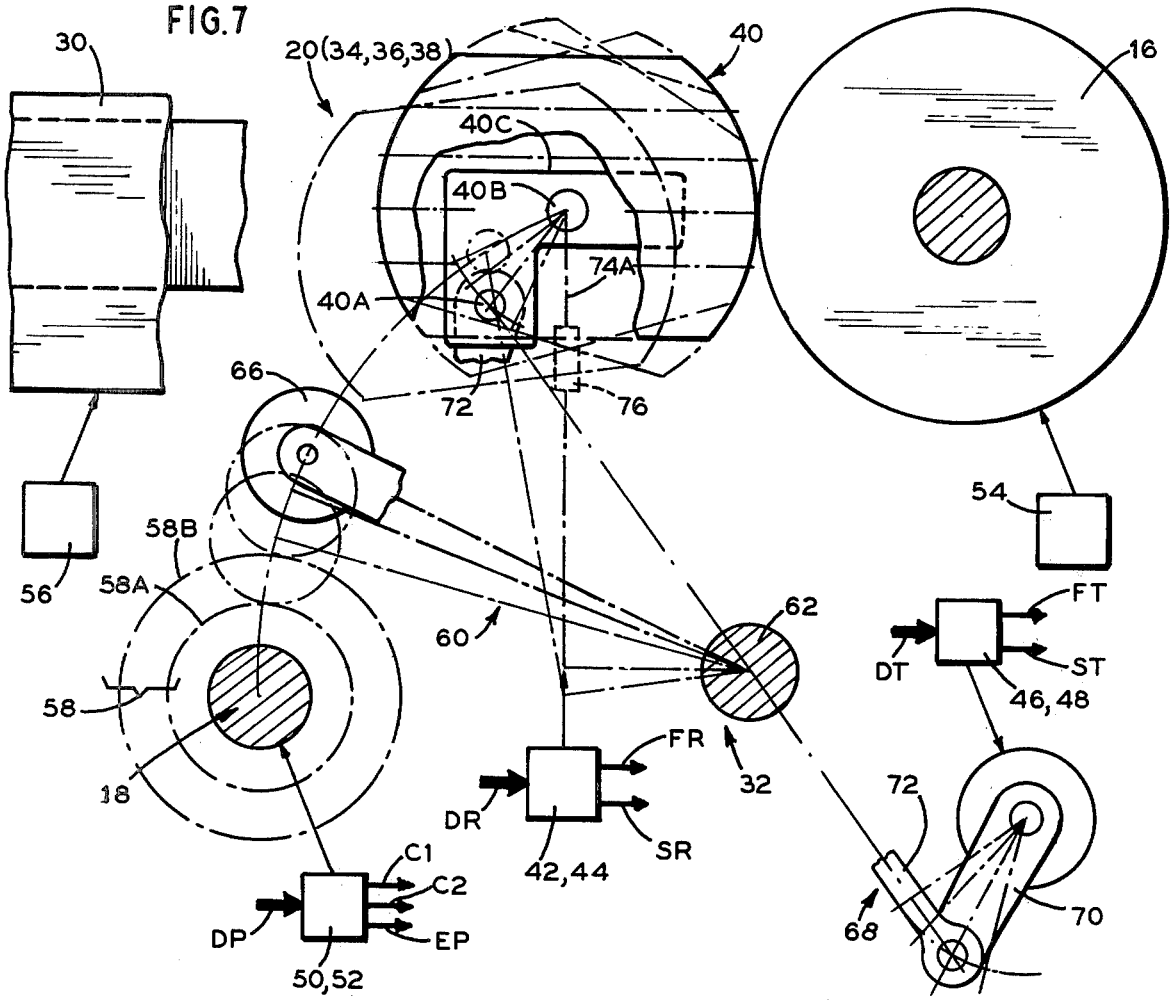
FIG. 7 is a diagrammatic side view of the printer of FIG. 6 showing cooperating elements and their logic-controlled energizing means.
Figure 6:
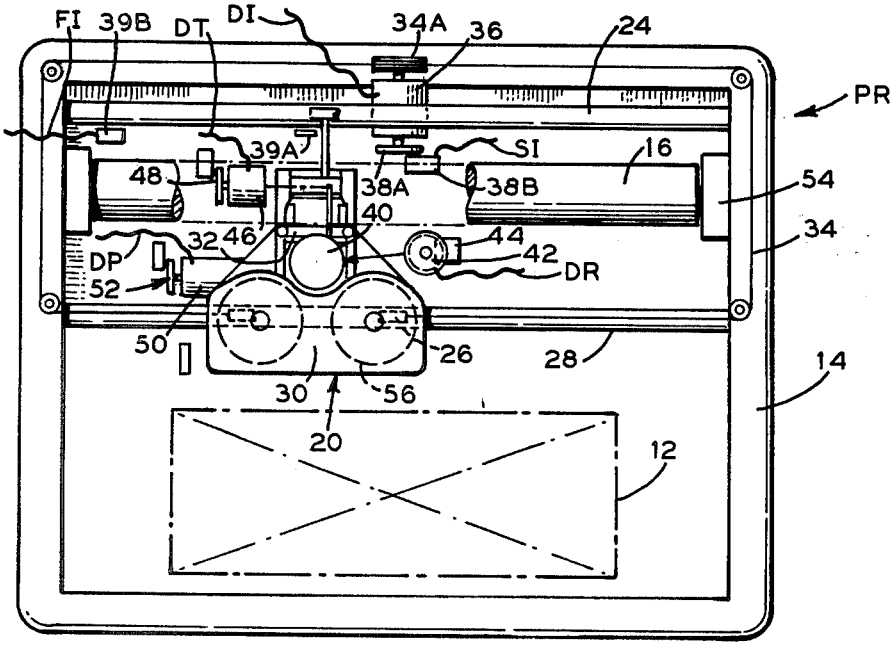
FIG. 6 is a plan view of the printer of FIG. 1, the view omitting unrelated parts and being partially diagrammatic.

Referring to FIG. 6 through FIG. 11 and to FIGS. 6 and 7 in particular, printer PR shows a frame 14 spindling a platen 16. A print carrier assembly 20 is trunnioned at a pair of rollers 22 straddling a traverse rod 24 fixed in frame 14 and pairs of rollers 26 stradding a traverse rod 28 also fixed in frame 14.

Carrier 20, comprising a ribbon-feed 30, a print head 32 and a step motor 50, is stepped via a cable means 34, by a step motor 36. A transducer 38, on motor 36 relays information to index control IC of FIG. 1.

In particular, when step motor 36 receives the stepping signals on cable DI from index control IC, the motor rotates pulley 34A causing the cable means 34 to move the carrier 20 to the left or right. At the same time, transducer 38 which can comprise a disc 38A with a band of slots, and a light source-light sensitive cell, such as a light emitting diode-photosensitive solid state device stradding the band indicated generally as combination 38B, emits a pulse on line SI each time a slot dics 38A is operatively opposite combination 38B. In addition, carrier 20 carries a light interposer 39A which interrupts a light path established between a light source and a light sensitive cell indicated generally at 39B to cause the transmission of a pulse on line FI to index control IC when the print carrier 20 is at the left hand margin.

The print head has rotate step motor 42 which rotates in a clockwise or counter-clockwise direction as viewed in FIG. 6 in response to step signals received on cable DR from the rotation control RC of FIG. 1. Connected to the shaft of motor 42 is a slotted disc having one band of twenty-two equispaced slots (one for each character in a row) and a second band with a single slot. Each of the bands is straddled by light source-light sensitive cell combinations indicated generally by box 44. Thus as the motor 42 is stepped a pulse is emitted on line SR as each of the slots of the first band is sensed. In addition, whenever the slot of the second band is sensed a pulse is emitted on line FR to rotation control RC of FIG. 1. The details of how step motor 42 rotates print head 40 will be described hereinafter in detail.

A tilt step motor 46 rotates clockwise or counter-clockwise in response to step signals received on cable DT from tilt control TC of FIG. 1. Connected to the shaft of motor 46 is a slotted disc having one band with four slots one for each row of characters and a second band with a single slot, each of the bands is straddled by a light source-light sensitive cell combination indicated generally by box 48. Thus as the motor 46 is stepped a pulse is emitted on line ST as each slot of the first band is sensed, and whenever the slot of the second band is sensed a pulse is emitted on line FT to tilt control TC of FIG. 1.

Shaft 18 is driven by step motor 50 in response to stepping signals received on cable DP from print control PC. Connected to the shaft of motor 50 is a disc having three slots, each in different bands, straddling each band is a light source, light sensitive cell combination indicated generally by box 52. Thus, as the motor 46 is stepped a pulse is emitted sequentially on lines C1, C2 and EP. The positions of the slots associated with lines C1 and C2 are chosen to indicate when the actual printing is being performed as will hereinafter become apparent.

The platen-rotation means 54 and ribbon-feed means 56, although linked operatively through manual, mechanical and logic control, are not a part of the invention, and therefore are referenced for edification only.

The basic operations and logic references shown in FIG. 7 center around velocity-controlled cam 58 which cooperates with follower 66 to impel the rocker assembly 60 of print head 32 clockwise around bearing 62 driving the print shell 40 toward platen 16. Cam 58 is fixed on shaft 18 which is spindled on carrier 20. Shaft 18 is rotated by step motor 50 which is preferably mounted on carrier 20. In fact, shaft 18 can be the shaft of motor 50. In this way, the print head driving mechanism is greatly simplified over previously known driving mechanisms. (Two additional cams, described hereinafter, are also mounted on shaft 18.)

Figure 8:
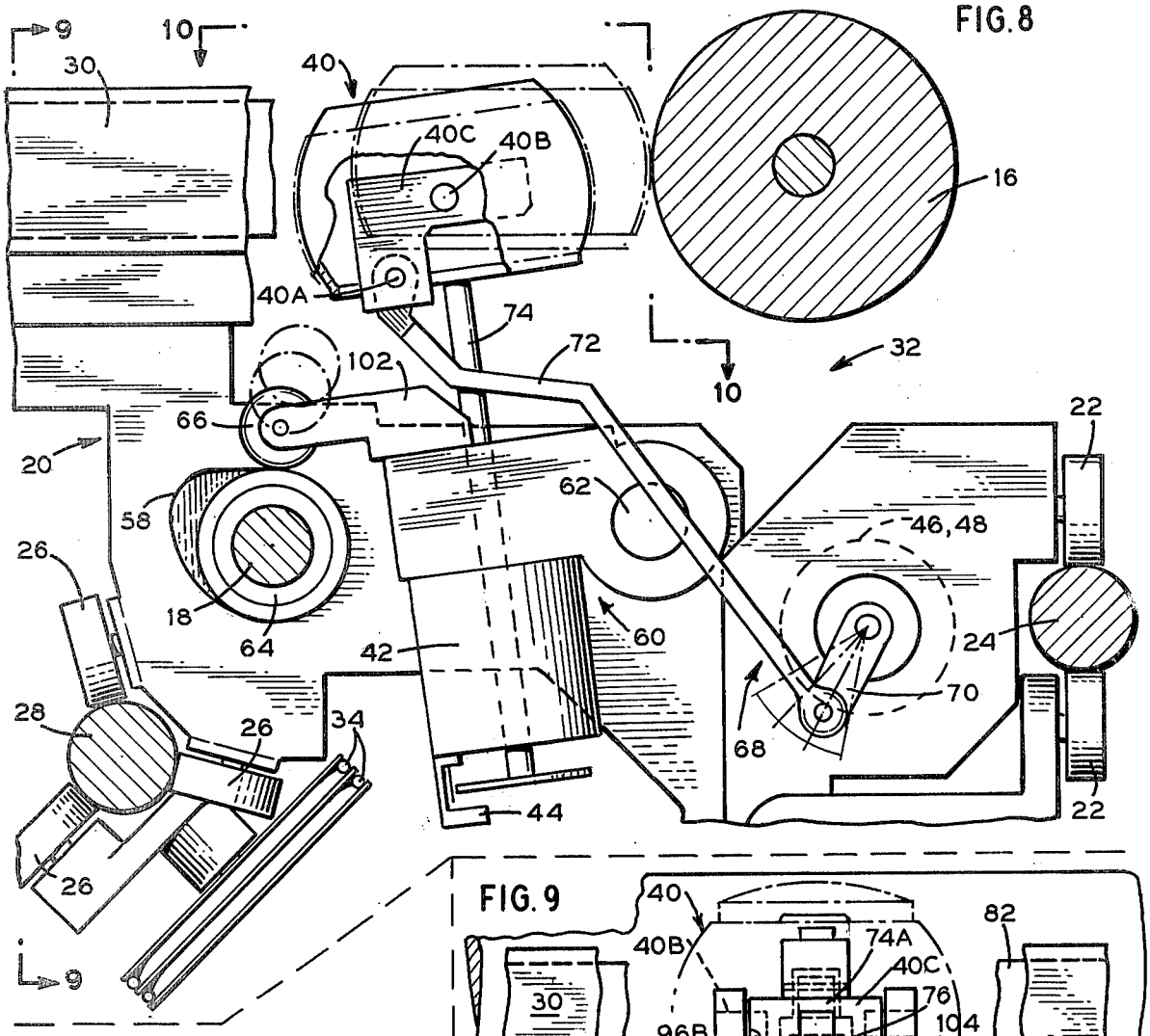
FIG. 8 is a view similar to FIG. 7 except that structure is clarified, energizing means are omitted or shown schematically and the print head or rocker assembly is retracted.
Figure 9:
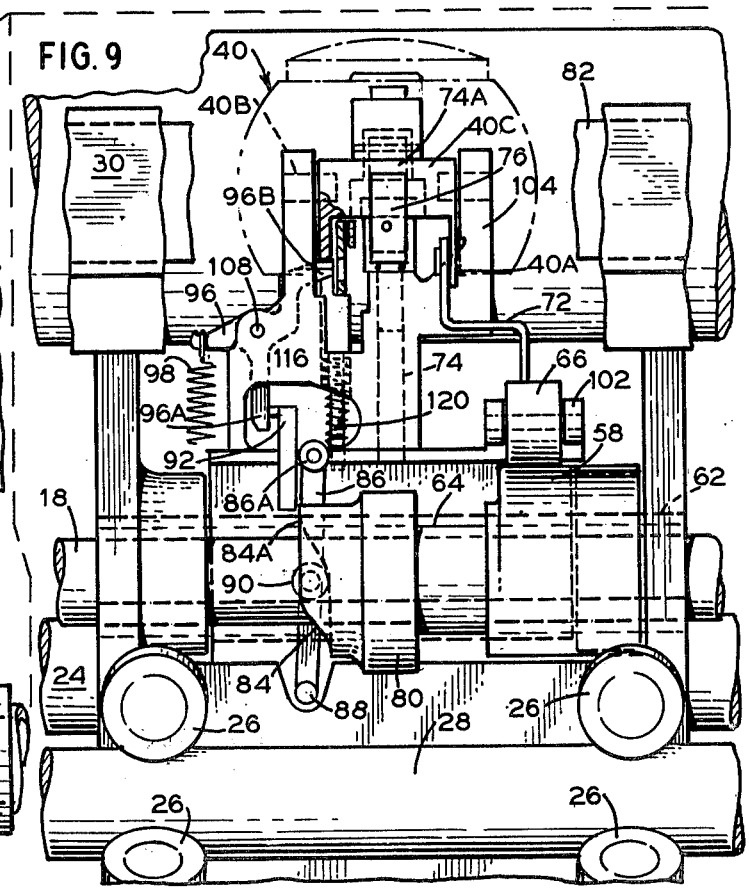
FIG. 9 is a front view taken on line 9—9 in FIG. 8, parts broken away or are phantom outline and similar except that the rocker assembly is in the print position.
Figure 10:
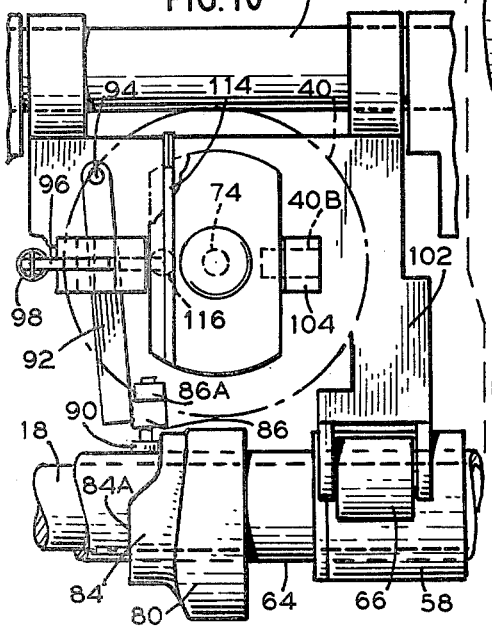
FIG. 10 is a fragmentary plan view taken on the line 10—10 in FIG. 8.
Figure 12:
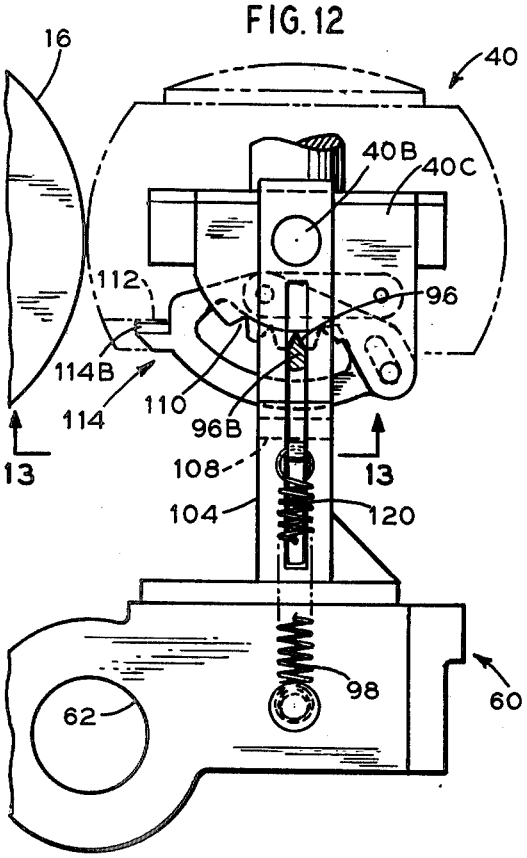
FIG. 12 is a side view thereof.
Figure 11:
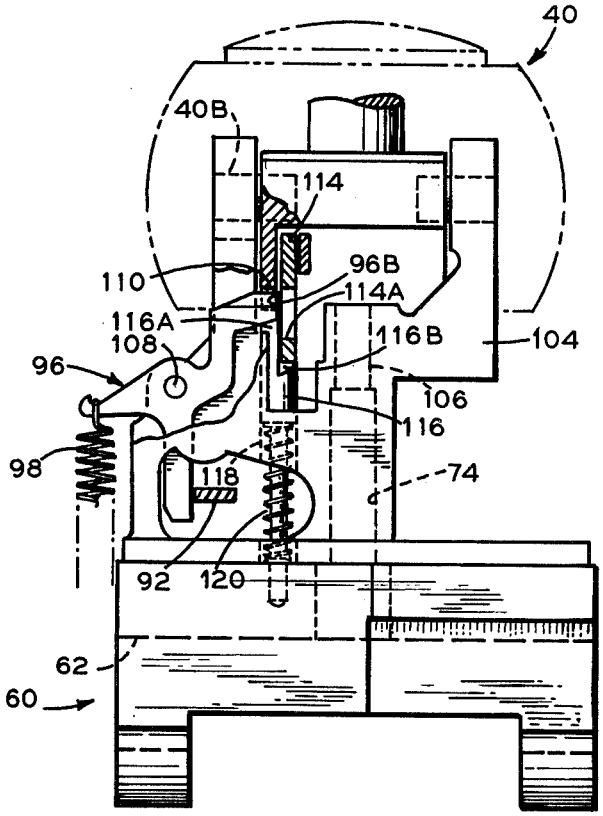
FIG. 11 is an enlarged fragmentary view of FIG. 9.

As best seen in FIGS. 8, 9, and 10, the print head 32 comprises the rocker assembly 60 and the tilt means 68.

The rocker assembly includes pivotable base member 60, mounted for rotation about bearing 62. The member 60 has a yoke 104 and an arm 102 which carries cam follower 66. Yoke 104 spindles print shell 40 at bearings 40B, spindles shaft 74 in a bearing 106 (See also FIG. 11) and arm 96 in a bearing 108.

Passing through the base of rocker 60 is shaft 74 of motor 42 having one end connected to universal joint 76. (See particularly FIG. 9). Above universal joint 76, the upper section 74*a* of shaft 74 is journaled through a housing 40*c*, tiltable on bearings 40*b*, to connection with print shell 40. The other end of shaft 74 is the shaft of motor 42 whose housing is mounted on the rocker. Thus rotation of motor 42 presents the twenty-two different angular positions each associated with a different character in the rows of characters on print shell 40 to platen 16.

In this way there is a minimum of mechanical connections between the rotate motor 42 and the print shell 40. Thus, leading to a simplification of structure which increases the potential life of the device and permits higher speed operation of the device. In addition, by supporting the rotate motor on the rocker assembly increases the mass of the assembly. Therefore, lower impact velocities can be used to control the print impression. Consequently, less noise is generated upon impact.

The tilt means 68 comprises the motor 46 mounted on carrier 20. The shaft of motor 46 is connected via arm 70 and link 72 to bearing 40*a* in housing 40*c*. By this means, the rotation of motor 46 selects which of the rows of characters on shell 40 is to be presented to platen 16. It should be noted that since link 72 connected between bearing 40*a* and pin 70*a* passes through the pivot point of rocker 60 (i.e. bearing 62) as shown in FIGS. 7 and 8 the differential linkage length is minimized during the pivoting of the rocker assembly 60.

In FIGS. 9 and 10 there is shown on shaft 18 a ribbon feed cam 80 for controlling the ribbon 82. Since the ribbon feed portion of the printer forms no part of the present invention and will not be discussed further.

In addition, shaft 18 has a detent-control cam 84. An arm 86, spindled at a bearing 88, carries a cam follower 90. The outer end of arm 86 spindles a roller 86*a* engaged by a second arm 92 spindled at a bearing 94. Arm 92, in turn, is engaged by a detent arm 96 that is biased counter-clockwise by a first spring 98 and by a second spring to be described.

As practiced in the prior art, arm 96 engages one of four tilt detents 110 directly and disengages one of twenty-two rotation detents 112, indirectly, by downward pressure on a slotted sector 114. However, to obtain high operative speeds, through logic control, without adding wear, and deterioration of reliability, positive engagement of the detents is increased and friction at the arcuate contact surface 114*a* of sector 114 during disengagement is decreased in a new and novel manner.

Figure 14:
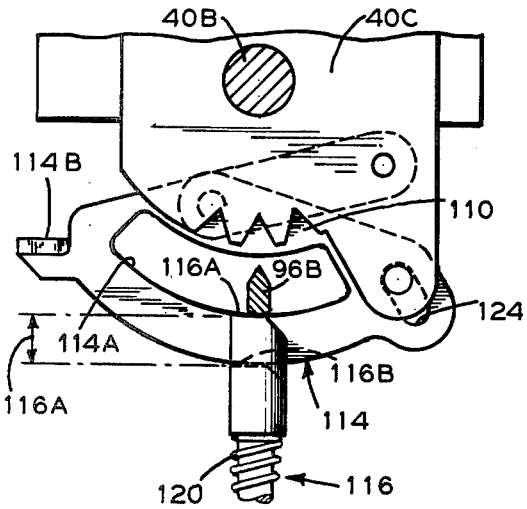
FIG. 14 is an enlarged fragmentary view of FIG. 12 except that the mechanism is shown in the position wherein the printing element detents are retracted.
Figure 13:
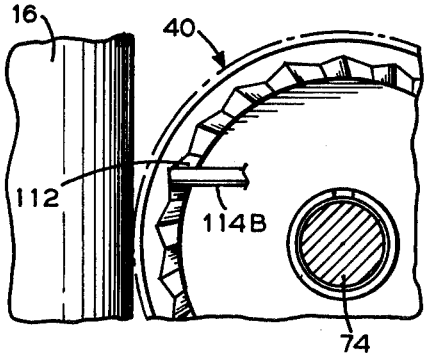
FIG. 13 is a bottom view taken on line 13—13 in FIG. 12.

In FIGS. 9 to 14, a plunger 116, slidably fitted in a hole 118 has a high shoulder 116*a* and a low shoulder 116*b* (See especially FIG. 14). A spring 120 biases plunger 116*b* upwards, and through contact at shoulder 116*a*, cooperates with spring 98 to obtain positive engagement of arm 96 in tilt detent 110. Additionally, through contact of shoulder 116*b* with sector 114, spring 120 operates to obtain positive engagement of arm 114 in rotate detent 112 (see FIG. 13).

By this means, it will become evident that arm 114 can be made rapidly, yet reliably responsive without friction between the bottom surface of finger 96*b* and the surface 114*a*. The height of sector 114 at this point is less than the spacing 116*c* between the shoulders 116*a* and 116*b* so that in the undetented position of finger 96*b* no friction exists between the aforesaid surfaces. However, when finger 96*b* seats in detent 110 sufficient over travel of nose 114*b* is available to seat it in rotate detent 112.

In operation, rotate motor 42 rotates shaft 74 to select the "column" of the desired character on print shell 40 while at the same time tilt motor 46 operative via link 72 tilts print shell 40 to the row of the desired character. As these motions are ending print motor 50 drives shaft 18 to perform one revolution. During the revolution three motions are performed as a result of the rotation of cam 58 to drive rocker number 60, a rotation of cam 80 to move ribbon 82 and a rotation of cam 84 to control the detenting of the print shell 40. It is the detenting of the print shell before and during impact which enhances the print quality.

Normally, i.e. with shaft 18 in its rest position, roller 90 rests on crest 84*a* of cam 84, arm 86 is pivoted counterclockwise (see FIG. 9) pressing against finger 96*a* of arm 96. Thus arm 96 is rotated clockwise about pin 108 causing its other finger 96*b* to be clear of detents 110. This finger also presses down on sector 114 (see FIG. 14) causing nose 114*b* to clear detents 112 (See FIG. 13). In this position the print shell 40 is fully tiltable and rotatable in response to its associated motors. Now as the shaft rotates roller 90 assumes the position shown in FIGS. 9 and 10. Then finger 96*b* is driven up into a detent 110 by virtue of spring 98 rotating arm 96 counter-clockwise about pin 108 and by spring 120 pushing the shoulder 116*a* against finger 96*b*. In addition, detent nose 114*b* is driven into detent 112 by spring 120 acting via the second shoulder 116*b* pushes arm 114 in the clockwise direction. Now the print shell 40 is mechanically locked in position.

Inspection will further show that particularly at high speeds, the vertical spacing 116*c*, between shoulders 116*a* and 116*b* ensures that engagement of arm 96 in detent 110 and rotational positioning of element 40 are completed before nose 114*b* moves into detent 112. Thus, detent nose 114*b* moves in with greater reliability and less wear.

At that same time rocker assembly 60 responds to follower 66 mounted thereon. This response moves print shell 40 towards platen 16 in two separate velocity patterns. Follower 66 is first accelerated by the rise in cam 58 from the dwell 58*a* to, substantially, the peak 58*b*, from which point velocity is imparted to the mass of print head 32. In this manner, print shell 40 prints characters at variable pressure dependent upon acceleration changes in motor 50.

Finally cam 80 causes the indexing of ribbon 82. Then all motions ceases until another character is called for.

The overriding observation in comparing the mechanical anical embodiment of the present invention to the present art, in printing element articulation, is the great reduction in parts with its obvious advantages consonant with high speed operation. Printing speed is thereby brought closer to the speeds available with logic and servos above-described.

While specific circuits, components and devices have been shown and described it should be realized that they are not unique. For example, the translator TRS can be decoding matrices, read only memories, programmable read only memories, random access memories, etc. In addition, the drive motors were described as step motors. However, they can be any type of servomotor and particularly bidirectionally controlled D.C. motors. The transducers were shown as opto-electrical devices. They could be any shaft position indicating devices using conductive, magnetic, capacitive or other techniques.

While only one embodiment of the invention has been shown and described in detail there will now be obvious to those skilled in the art many modifications and variations satisfying many or all of the objects of the invention but which do not depart from the spirit thereof.

What is claimed is:

1. A printer comprising a platen, a rocker means, a print shell having a plurality of type characters thereon, a support means on said rocker means to support said print shell to rotate about a first axis and to tilt about a second axis, a first motor having a shaft, said first motor and shaft being carried by said rocker means, means for connecting the shaft of said first motor to said print shell for rotating the latter whereby a unitary structure is obtained, means for pivoting about a third axis said rocker means carrying said print shell and said first motor to drive a type character on said print shell against said platen, a second motor supported remotely from said rocker means, an arm connected to said second motor, and a link having one end pivotably connected to said arm and a second end pivotably connected to said support means, a straight line joining the ends of said link passing through said third axis about which said rocker means pivots.

2. A printer comprising a platen, a rocker means, a print shell on said rocker means having a plurality of type characters, means on said rocker means for driving said print shell to rotate about a first axis, means for pivoting said rocker means about a pivot axis to drive a type character on said print shell against said platen, a support means on said rocker means to support said print shell to tilt about a second axis, a motor supported remotely from said rocker means, an arm connected to said motor, a link having one end pivotably connected at a first point to said arm and a second end pivotably connected at a second point to said support means, the line connecting said points passing through said pivot axis.

3. The printer of claim 2 wherein said print shell is in the form of a truncated sphere and having a plurality of rotate detents along a peripheral edge of the truncated sphere and wherein there are a plurality of tilt detents in said support means, further comprising a slotted sector arm pivotably connected to said support means and having a detent nose positioned opposite said rotate detents, a detent arm, means for moving said detent arm between first and second positions, said detent arm passing through the slot of said slotted sector arm and opposite said tilt detents to apply pressure to said sector arm to move it away from said rotate detents when said detent arm is in the first position and to remove such pressure whereby said detent nose can engage one of said tilt detents when said detent arm is in the second position, a plunger having a first shoulder resting against said detent arm and a second shoulder resting against said sector arm, and a spring for biasing said plunger to move in a given direction to urge said detent arm into engagement with one of said tilt detents and to urge said detent nose into engagement with one of said rotate detents.

4. A printer comprising a platen, a print shell having a plurality of type characters and being in the form of a truncated sphere, said print shell having a plurality of rotate detents along a peripheral edge of the truncated sphere, support means for supporting said print shell to rotate about a first axis and tilt about a second axis, a plurality of tilt detents in said support means, a slotted sector arm pivotably connected to said support means and having a detent nose positioned opposite said rotate detents, a detent arm, means for moving said detent arm between first and second positions, said detent arm passing through the slot of said slotted sector arm and opposite said tilt detents to apply pressure to said sector arm to move it away from said rotate detents when said detent arm is in the first position and to remove such pressure whereby said detent nose can engage one of said rotate detents and also engage one of said tilt detents when said detent arm is in the second position, a plunger having a first shoulder resting against said sector arm, a spring for biasing said plunger to move in a given direction to urge said detent arm into engagement with one of said tilt detents and to urge said detent nose into engagement with one of said rotate detents, means for impelling said print shell against said platen, and means for driving said detent arm into said second position when said print shell is being impelled.

5. A printer comprising: a platen; a print head, said print head having a print element upon which are type characters, said print element comprising a print shell and means for supporting said print shell to rotate about a first axis and tilt about a second axis; a rocker means for supporting said print element, a cam follower connected to said rocker means, and means for mounting said rocker assembly to pivot so that said print element can move against said platen; a drive shaft, a cam on said drive shaft and operatively cooperative with said cam follower so that as said drive shaft rotates said print element is driven toward said platen, and drive means for rotating said shaft at different speeds; and positioning means for selectively moving said print element to position a particular type character operatively opposite said platen for printing, said positioning means comprising rotating means for rotating said print shell, and tilting means for tilting said print print shell, said tilting means comprising a motor supported remotely from said rocker means, an arm connected to said motor, and a link having one end pivotably connected to said arm and a second end pivotably connected to said support means, said link passing through the pivot axis of said rocker means.

6. The printer of claim 5 wherein said print shell is in the form of a truncated sphere and having a plurality of rotate detents along a peripheral edge of the sphere, a slotted sector arm pivotably connected to said support means and having a detent nose positioned opposite said rotate detents, a detent cam on said drive shaft, a detect cam follower operatively opposite said detent cam, a detent linkage connected to said cam follower and having a detent arm passing through the slot of said slotted sector cam and opposite said tilt detents press said sector arm away from said rotate detents when said drive shaft is in a first position and to remove such pressure when said drive shaft is in a second position, and a plunger having a first shoulder resting against said detent arm and a second shoulder resting against said sector arm, and a spring for biasing said plunger to move in a given direction to urge said detent arm into engagement with one of said tilt detents and to urge said detent nose into engagement with one of said rotate detents.

* * * * *